US005896676A

United States Patent [19]

Barousse

[11] Patent Number: 5,896,676

[45] Date of Patent: Apr. 27, 1999

[54] WADE FISHING LEG GAITER

[75] Inventor: John F. Barousse, Tiki Island, Tex.

[73] Assignee: Island Aerobics, Inc., Tiki Island, Tex.

[21] Appl. No.: 08/907,766

[22] Filed: Aug. 8, 1997

[51] Int. Cl.[6] ..... A41D 17/00

[52] U.S. Cl. ..... 36/2 R

[58] Field of Search ..... 36/2 R, 1.5, 2 B

[56] References Cited

U.S. PATENT DOCUMENTS

| | | | |
|---|---|---|---|
| 1,651,589 | 12/1927 | Eggerth . | |
| 2,422,851 | 6/1947 | Randall . | |
| 3,128,565 | 4/1964 | Graham et al. . | |
| 3,613,681 | 10/1971 | Adams . | |
| 3,934,583 | 1/1976 | Hollingshead et al. . | |
| 4,062,133 | 12/1977 | McGee et al. . | |
| 4,599,812 | 7/1986 | Harmsen | 36/1.5 |
| 4,809,447 | 3/1989 | Pacanowsky | 36/9 R |
| 4,856,207 | 8/1989 | Datson | 36/2 R |
| 4,912,860 | 4/1990 | Keller . | |
| 5,249,375 | 10/1993 | Tabarly | 36/1.5 |
| 5,711,031 | 1/1998 | Clement . | |

*Primary Examiner*—Ted Kavanaugh

*Attorney, Agent, or Firm*—David P. Gordon; David S. Jacobson; Thomas A. Gallagher

[57] ABSTRACT

A wade fishing gaiter is made of a neoprene foam material which is approximately 0.25 to 0.375 inches thick. The material is cut and stitched to form a gaiter which is dimensioned lengthwise to cover the front of the leg from above the knee to the ankle and the back of the leg from below the knee joint to the ankle. The gaiter is dimensioned widthwise to fit snugly over the bare leg thereby providing muscle support. The gaiters according to the invention are intended to be worn over bare legs and used in conjunction with diving boots for foot protection. The dimensions and materials used to construct the gaiters provide for comfort and muscle support as well as good protection against underwater hazards such as oysters, coral and stinging fish. The gaiters are also light weight and do not inhibit movement of the angler's legs. In cold weather, the gaiters are advantageously used in conjunction with waders and protect the legs from blisters normally caused by waders. According to a presently preferred embodiment, each gaiter is made from two pieces of material which are attached to each other at longitudinal edges which are glued and sewn together with a cross-over stitch. The upper and lower edges or hems are preferably roll lapped and sewn.

14 Claims, 1 Drawing Sheet

WADE FISHING LEG GAITER

BACKGROUND OF THE INVENTION

1. Field of the Invention

The invention relates to fishing gaiters. More particularly, the invention relates to wade fishing gaiters which protect the angler's legs and also provides muscle support for the lower legs.

2. State of the Art

Wade fishing is a sport in which the angler stands approximately knee deep in a body of water while fishing. Various articles of clothing are available to keep the angler's legs warm and dry while wade fishing. These include articles of clothing called "waders" which are relatively large, bulky waterproof trousers having integral boots. While waders are effective in keeping the angler's legs warm and dry, they inhibit movement of the legs and make it difficult for the angler to walk, especially in water. In addition, the waders are typically made of a rough fabric which can cause blisters on the angler's ankles and calves.

In warm weather, keeping the angler's legs warm is less important and waders may actually make the angler uncomfortably warm. Bare legged wade fishing can be hazardous because of underwater obstacles and stinging fish. For example, when wade fishing on a coral reef, the angler's legs can be seriously cut by unseen sharp coral. Oyster beds are primary sites for wade fishing throughout the Gulf of Mexico. The sharp edged oyster shells present a serious hazard to unprotected legs. Fish such as sting rays and jelly fish also present a hazard for a bare legged angler. In these situations, an angler may choose to wear "gaiters" rather than waders. Gaiters are articles of clothing which cover the lower leg from the knee to the ankle or instep. Gaiters are generally worn in conjunction with boots to provide protection for the feet. Most known gaiters are designed to keep the lower legs and/or feet dry and do not offer substantial protection against underwater hazards. For example, U.S. Pat. No. 4,856,207 to Datson discloses a shoe and gaiter which are attached to each other by a waterproof seal. The upper part of the gaiter has a draw string for making the gaiter tight around the leg. The gaiter is made of relatively thin foldable material so that it can be rolled down to the shoe when not needed. The Datson gaiter is probably effective for what it is intended to do, keep water out. However, it is likely to be uncomfortable when tightened around the upper part. In addition, the gaiter is not likely to provide much protection against underwater hazards such as coral and stinging fish.

It is not uncommon for a wading angler to slip or trip, resulting in lacerations of the knee and/or lower leg caused by oyster shells or other bottom debris.

In addition to the above-mentioned hazards of wade fishing, standing for long periods of time in water can be tiring because of the strain placed on the muscles of the lower leg.

SUMMARY OF THE INVENTION

It is therefore an object of the invention to provide wade fishing gaiters which protect the angler's legs from underwater hazards.

It is also an object of the invention to provide wade fishing gaiters which do not impede movement of the angler's legs.

It is another object of the invention to provide wade fishing gaiters which are comfortable to wear.

It is still another object of the invention to provide wade fishing gaiters which relieve muscle strain when standing for long periods of time.

In accord with these objects which will be discussed in detail below, a wade fishing gaiter of the present invention is made of a neoprene foam material which is approximately 0.25 to 0.375 inches thick. The material is cut and stitched to form a gaiter which is dimensioned lengthwise to cover the front of the leg from above the knee to the ankle and the back of the leg from below the knee joint to the ankle. The gaiter is dimensioned widthwise to fit snugly over the bare leg thereby providing muscle support. The gaiters according to the invention are intended to be worn over bare legs and used in conjunction with diving boots for foot protection. The dimensions and materials used to construct the gaiters provide for comfort and muscle support as well as good protection against underwater hazards such as coral and stinging fish. The gaiters are also light weight and do not inhibit movement of the angler's legs. In cold weather, the gaiters are advantageously used in conjunction with waders and protect the legs from blisters normally caused by waders.

According to a presently preferred embodiment, each gaiter is made from two pieces of material which are attached to each other by gluing and/or sewing (with a cross-over stitch) at longitudinal edges. The upper and lower edges or hems are preferably roll lapped and sewn.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 3:
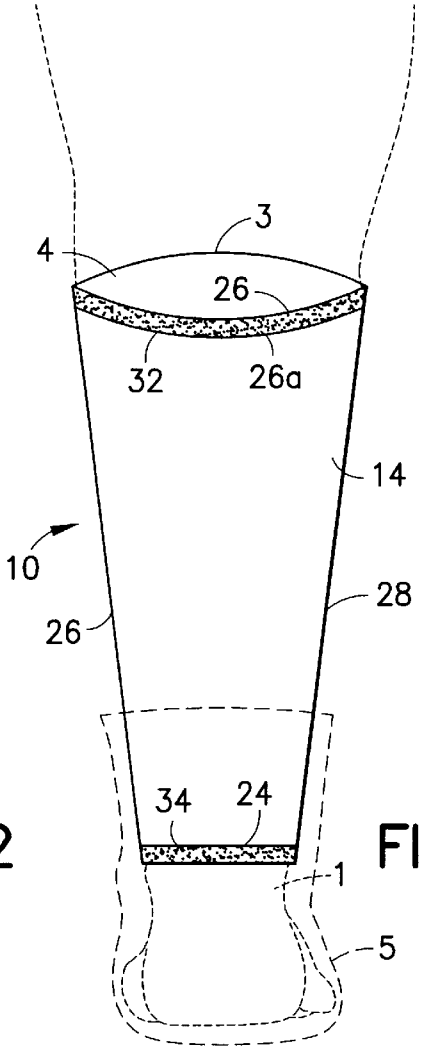
FIG. 3 is a rear elevational view of the leg gaiter of FIGS. 1 and 2.
Figure 2:
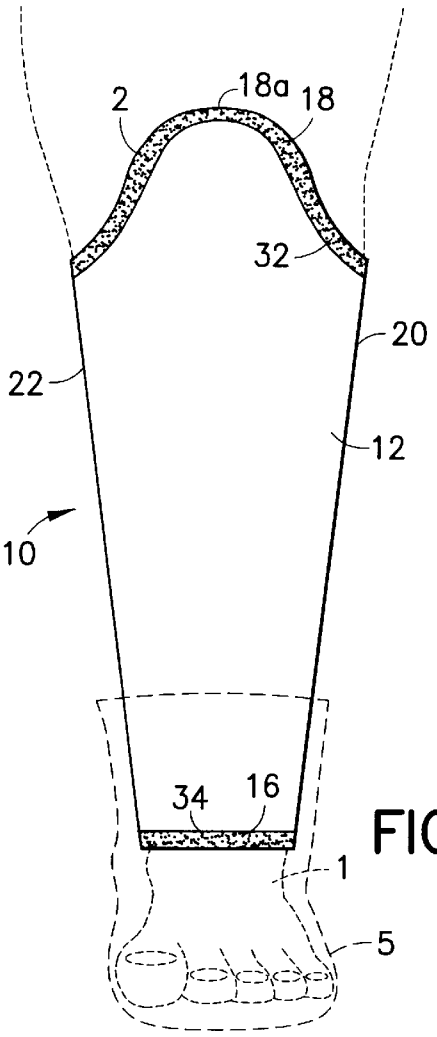
FIG. 2 is a front elevational view of the leg gaiter of FIG. 1.
Figure 1:
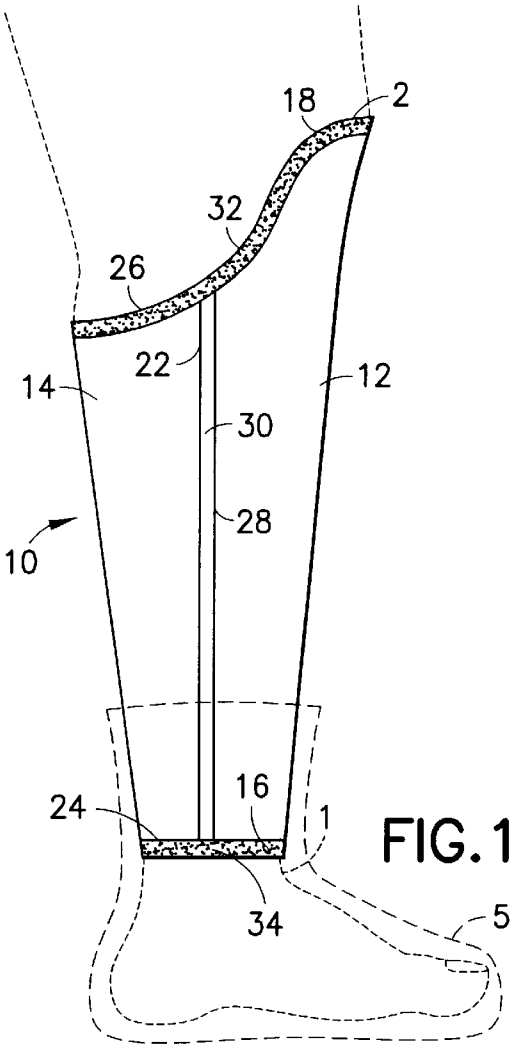
FIG. 1 is a side elevational view of a wade fishing leg gaiter according to the invention.

Referring now to FIGS. 1 through 3, a wade fishing gaiter 10 according to the invention is made from two pieces of neoprene foam material 12, 14 each of which is approximately 0.25 to 0.375 inches thick. The first piece of material 12 is cut with a straight lower edge 16, a sinusoidally curved upper edge 18, and angled side edges 20, 22. The overall length from the lower straight edge 16 to the highest point 18*a* on the curved upper edge 18 is long enough to span the distance from an angler's ankle 1 (shown schematically in phantom) to a point above the knee 2 (shown schematically in phantom). For an average adult, this length is approximately twenty-one inches. The length of the side edges 20, 22 is shorter and designed to span from the ankle to a point below the knee. For an average adult, this length is approximately sixteen and one-eighth inches. The overall width of the lower edge 16 is chosen to be slightly less than half the circumference of the ankle 1. For an average adult, this width is approximately four and one-quarter inches. The overall width of the upper edge 18 is chosen to be slightly less than half the circumference of the upper calve 4. For an average adult, this width is approximately seven and one-half inches.

The second piece of material 14 is cut with a straight lower edge 24, a slightly scooped downwardly curved upper edge 26, and angled side edges 26, 28. The overall length from the lower straight edge 24 to the lowest point 26*a* of the upper edge 26 is designed to span the distance from the angler's ankle 1 to the a point below the knee joint 3. For an average adult, this length is approximately fifteen inches. The length of the side edges 26, 28 is chosen to match the length of the side edges 20, 22 of the first piece of material 12. The overall widths of the upper and lower edges are chosen to match the widths of the upper and lower edges of the first piece of material 12.

The first piece of material 12 is attached to the second piece of material 14 by gluing the side edge 22 to the side edge 28 and by gluing the side edge 20 to the side edge 26. After gluing, the joined edges are preferably sewn with cross-over stitching as shown for example in FIG. 1 at 30.

According to a presently preferred embodiment, the now joined upper edges 18, 26 and lower edges 16, 24 of the two pieces 12, 14 are roll lapped and sewn as shown, for example, by the shaded portions 32, 34.

From the foregoing, it will be appreciated that the gaiter 10 is dimensioned lengthwise to cover the front of the leg from above the knee 2 to the ankle 1 and the back of the leg from below the knee joint 3 to the ankle 1. The gaiter 10 is dimensioned widthwise to taper toward the ankle 1 and fit snugly over the bare leg thereby providing muscle support. The gaiters according to the invention are intended to be worn over bare legs and used in conjunction with diving boots 5 (shown schematically in phantom) for foot protection. The dimensions and materials used to construct the gaiters provide for comfort and muscle support as well as good protection against underwater hazards such as coral and stinging fish. The gaiters are also light weight and do not inhibit movement of the angler's legs. In cold weather, the gaiters are advantageously used in conjunction with waders and protect the legs from blisters normally caused by waders.

There have been described and illustrated herein a preferred embodiment of a wade fishing gaiter. However, it is not intended that the invention be limited thereto, as it is intended that the invention be as broad in scope as the art will allow and that the specification be read likewise. Thus, while particular dimensions have been disclosed, it will be appreciated that other dimensions could and should be utilized depending on the size of the person wearing the gaiters. Also, while gluing and stitching have been disclosed as the preferred manner of assembly, it will be recognized that other types of attachments could be used with similar results obtained. Moreover, while particular configurations have been disclosed in reference to rolling the upper and lower edges, it will be appreciated that other configurations could be used as well to ensure that the edges are smooth. Furthermore, while the gaiter has been disclosed as being constructed from two pieces of material, it will be understood that the gaiter could be made from a single piece of material or from more than two pieces of material. In addition, while the presently preferred material is neoprene foam material of a certain thickness, it will be understood that an equivalent material having similar elasticity for offering muscle support and similar density for protection from underwater hazards may yield substantially equivalent results.

It will therefore be appreciated by those skilled in the art that yet other modifications could be made to the provided invention without deviating from its spirit and scope as so claimed.

I claim:

1. A wade fishing gaiter for covering an angler's lower leg when wade fishing, comprising:

at least one piece of neoprene foam material which is cut and joined to fit snugly over the lower leg from the ankle to a point below the knee joint, said material being thick enough and dense enough to protect the leg from underwater hazards and being elastic enough to provide muscle support for the lower leg, wherein said cut and joined material defines a front portion which covers the leg from the ankle to a point above the knee and a rear portion which covers the leg from the ankle to a point below the knee joint, said front portion having an upper edge which terminates at a point above the knee and said rear portion having an upper edge which terminates at a point below the knee.

2. A wade fishing gaiter according to claim 1, wherein:

said front portion has an upper edge which is curved in a substantially sinusoidal manner.

3. A wade fishing gaiter according to claim 1, wherein:

said material is approximately 0.25 to 0.375 inches thick.

4. A wade fishing gaiter according to claim 1, wherein:

said front portion is approximately twenty-one inches long and said rear portion is approximately fifteen inches long.

5. A wade fishing gaiter according to claim 1, wherein:

said material is joined by gluing and stitching.

6. A wade fishing gaiter according to claim 1, wherein:

said material has an upper edge which is roll lapped and sewn, and a lower edge which is roll lapped and sewn.

7. A wade fishing gaiter according to claim 1, wherein:

said at least one piece of material comprises two pieces of material which are joined by gluing and stitching.

8. A wade fishing gaiter for covering an angler's lower leg when wade fishing, comprising:

a first piece of neoprene foam material having an upper edge, a lower edge, and first and second angled side edges, a second piece of neoprene foam material having an upper edge, a lower edge, and first and second angled side edges, said first side edge of said first piece of neoprene foam being joined to said first side edge of said second piece of neoprene foam, said second side edge of said first piece of neoprene foam being joined to said second side edge of said second piece of neoprene foam, said first piece of neoprene foam material and said second piece of neoprene foam material being dimensioned such that said gaiter fits snugly over the lower leg from the ankle to a point below the knee joint with said upper edge of said first piece of neoprene terminating above the knee and said upper edge of said second piece of neoprene terminating below the knee.

9. A wade fishing gaiter according to claim 8, wherein:

said first piece of material is dimensioned to cover the lower leg from the ankle to a point above the knee.

10. A wade fishing gaiter according to claim 9, wherein:

said upper edge of said first piece of material is curved in a substantially sinusoidal manner.

11. A wade fishing gaiter according to claim 9, wherein:

said first piece has an overall length of approximately twenty-one inches, and said second piece has an overall length of approximately fifteen inches.

12. A wade fishing gaiter according to claim 8, wherein:

said first side edge of said first piece of neoprene foam is joined to said first side edge of said second piece of neoprene foam by gluing and stitching, said second side edge of said first piece of neoprene foam is joined to said second side edge of said second piece of neoprene foam by gluing and stitching.

13. A wade fishing gaiter according to claim 8, wherein:

said upper edges of said first and second pieces are roll lapped and sewn, and said lower edges of said first and second pieces are roll lapped and sewn.

14. A wade fishing gaiter according to claim 8, wherein:

said first and second pieces are approximately 0.25 to 0.375 inches thick.

* * * * *